US010413950B2

(12) United States Patent
Weinzierl

(10) Patent No.: US 10,413,950 B2
(45) Date of Patent: Sep. 17, 2019

(54) COOLING PATH WITH TWOFOLD COOLING TO A RESPECTIVE TARGET VALUE

(71) Applicant: PRIMETALS TECHNOLOGIES GERMANY GMBH, Erlangen (DE)

(72) Inventor: Klaus Weinzierl, Nürnberg (DE)

(73) Assignee: PRIMETALS TECHNOLOGIES GERMANY GMBH (DE)

( * ) Notice: Subject to any disclaimer, the term of this patent is extended or adjusted under 35 U.S.C. 154(b) by 261 days.

(21) Appl. No.: 15/114,647

(22) PCT Filed: Jan. 15, 2015

(86) PCT No.: PCT/EP2015/050662
§ 371 (c)(1),
(2) Date: Jul. 27, 2016

(87) PCT Pub. No.: WO2015/113825
PCT Pub. Date: Aug. 6, 2015

(65) Prior Publication Data

US 2016/0346822 A1 Dec. 1, 2016

(30) Foreign Application Priority Data

Jan. 28, 2014 (EP) ..... 14152872

(51) Int. Cl.
*B21B 37/76* (2006.01)
*B21B 45/02* (2006.01)
(Continued)

(52) U.S. Cl.
CPC ..... *B21B 45/0203* (2013.01); *B21B 37/76* (2013.01); *C21D 11/005* (2013.01); *B21B 37/74* (2013.01); *C21D 8/0463* (2013.01)

(58) Field of Classification Search
CPC ..... B21B 37/74; B21B 37/76; B21B 45/0218; B21B 45/0233; B21B 45/0203; C21D 8/0263; C21D 11/005; C21D 8/0463
See application file for complete search history.

(56) References Cited

U.S. PATENT DOCUMENTS 6,225,609 B1 5/2001 Imanari et al. ..... 219/494
6,860,950 B2 * 3/2005 Franz ..... B21B 37/76 148/503
(Continued)

FOREIGN PATENT DOCUMENTS

CN 1589184 A 3/2005
CN 102015137 A 4/2011
(Continued)

OTHER PUBLICATIONS

First Office Action with Search Report dated Jul. 13, 2017 in corresponding Chinese Patent Application No. 201580006292.2 (with English language translation)(total 12 pages).
(Continued)

*Primary Examiner* — Edward T Tolan
(74) *Attorney, Agent, or Firm* — Ostrolenk Faber LLP

(57) ABSTRACT

As sections of a rolled product (1) pass through a cooling path (2), they are initially cooled in a first cooling phase by front cooling devices (6). The sections are then not cooled in a subsequent second cooling phase. They are finally cooled again in a subsequent third cooling phase, by rear cooling devices (8) of the cooling path (2). A control device (10) of the cooling path receives in each case an initial energy value (EA) exhibited by the sections before they pass through the cooling path (2). The control device furthermore receives a target energy (E1*) and a target enthalpy (E2*). The control device (10) determines a first target cooling medium profile (K1*) on the basis of the initial energy value (EA) and the target energy (E1*). The control device controls the front
(Continued)

cooling devices (6) in accordance with the first target cooling medium profile (K1*) while the respective section is passing through the front cooling devices (6). The control device (10) determines a second target cooling medium profile (K2) on the basis of an expected enthalpy for the respective section in the second cooling phase and the target enthalpy (E2*). The control device controls the rear cooling devices (8) in accordance with the second target cooling medium profile (K2*) while the respective section of the rolled product (1) is passing through the rear cooling devices (8).

10 Claims, 6 Drawing Sheets

(51) Int. Cl.

| | |
|---|---|
| ***C21D 11/00*** | (2006.01) |
| *B21B 37/74* | (2006.01) |
| *C21D 8/04* | (2006.01) |

(56) References Cited

U.S. PATENT DOCUMENTS

| | | | | |
|---|---|---|---|---|
| 6,866,729 | B2 * | 3/2005 | Gramckow | B21B 37/76 148/511 |
| 7,197,802 | B2 | 4/2007 | Kurz et al. | |
| 7,251,971 | B2 * | 8/2007 | Reinschke | B21B 37/74 700/153 |
| 7,449,140 | B2 * | 11/2008 | Franz | G05B 17/02 164/452 |
| 7,853,348 | B2 | 12/2010 | Weinzierl | |
| 7,865,341 | B2 * | 1/2011 | Borchers | G05B 17/02 703/2 |
| 7,938,917 | B2 | 5/2011 | Okamoto et al. | 148/505 |
| 8,369,979 | B2 | 2/2013 | Weinzierl | |
| 9,630,227 | B2 * | 4/2017 | Weinzierl | B21B 37/74 |
| 9,751,165 | B2 * | 9/2017 | Dagner | B21B 37/58 |
| 9,815,100 | B2 * | 11/2017 | Weinzierl | B21B 38/006 |

FOREIGN PATENT DOCUMENTS

| | | | |
|---|---|---|---|
| CN | 101745551 | B | 11/2011 |
| CN | 102534172 | A | 7/2012 |
| DE | 102008011303 | B4 | 6/2013 |
| EP | 1 244 816 | B1 | 3/2004 |
| EP | 1 576 429 | B1 | 6/2006 |
| EP | 1 596 999 | B1 | 12/2006 |
| EP | 1 397 523 | B1 | 8/2007 |
| EP | 1 732 716 | B1 | 9/2007 |
| EP | 1 970 457 | A1 | 9/2008 |
| EP | 1 444 059 | B1 | 8/2009 |
| EP | 2468905 | A1 | 6/2012 |
| EP | 2 244 850 | B1 | 1/2013 |
| EP | 2540404 | A1 | 1/2013 |
| JP | 2009-148809 | A | 7/2009 |
| JP | 2012-000663 | A | 1/2012 |
| JP | 2012-011448 | A | 1/2012 |
| JP | 2013-000766 | A | 1/2013 |
| WO | WO 01/47647 | A2 | 7/2001 |
| WO | WO 03/045599 AI | | 6/2003 |
| WO | WO 2004/076085 | A2 | 9/2004 |
| WO | WO 2005/099923 | A1 | 10/2005 |
| WO | WO 2013/000677 | A1 | 1/2013 |

OTHER PUBLICATIONS

International Search Report dated May 19, 2015 issued in corresponding International Application No. PCT/EP2015/050662.

Written Opinion dated May 19, 2015 issued in corresponding International Application No. PCT/EP2015/050662.

Opposition filed Aug. 1, 2018 by ArcelorMittal against corresponding European Patent No. 3 099 430.

Opposition filed Aug. 1, 2018 by SMS Group GmbH against corresponding European Patent No. 3 099 430.

* cited by examiner

COOLING PATH WITH TWOFOLD COOLING TO A RESPECTIVE TARGET VALUE

CROSS-REFERENCE TO RELATED APPLICATIONS

The present application is a 35 U.S.C. §§ 371 national phase conversion of PCT/EP2015/050662, filed Jan. 15, 2015, which claims priority of European Patent Application No. 14152872.9, filed Jan. 28, 2014, the contents of which are incorporated by reference herein. The PCT International Application was published in the German language.

TECHNICAL BACKGROUND

The present invention relates to an operating method for a cooling path for cooling a rolled product, particularly metal, preferably steel. As sections of the rolled product pass through the cooling path, they are initially cooled in a first cooling phase by front cooling devices of the cooling path using a liquid cooling medium. The rolled product sections, are then not cooled using the liquid cooling medium in a second cooling phase which follows the first cooling phase. The rolled product sections are finally cooled again by rear cooling devices of the cooling path using the liquid cooling medium in a third cooling phase which follows the second cooling phase.

A control device of the cooling path in each case receives an initial energy value which is exhibited by the rolled product sections before they pass through the cooling path, and the control device additionally receives a target energy.

On the basis of the initial energy value and the target energy, the control device determines a first target cooling medium profile which is to be applied to the respective section of the rolled product in the first cooling phase, and the control device activates the front cooling devices in accordance with the first target cooling medium profile while the respective section of the rolled product is passing through the front cooling devices.

The present invention further relates to a computer program comprising machine code which can be executed by a control device for a cooling path, wherein the execution of the machine code by the control device causes the control device to operate the cooling path in accordance with such an operating method.

The present invention further relates to a control device for a cooling path, wherein the control device is programmed by such a computer program.

The present invention further relates to a cooling path for cooling a rolled product. The cooling path has front and rear cooling devices, which apply a respective cooling medium quantity to a section of the rolled product that is situated in an active region of the respective cooling device. The cooling path has a transport device, which transports the rolled product through the cooling path, such that the sections of the rolled product pass through the active regions of the cooling devices in succession. A control device operates the cooling path in accordance with such an operating method.

Such an operating method is known from DE 10 2008 011 303 B4 (corresponding to U.S. Pat. No. 8,369,979 B2) and WO 2005/099 923 A1 (corresponding to U.S. Pat. No. 7,853,348 B2), for example. The operating method disclosed in DE 10 2008 011 303 B4, does not disclose in detail the form of the cooling during the third cooling phase.

In the operating method disclosed in WO 2005/099 923 A1, the rolled product is quenched to a target temperature or below in the third cooling phase.

Steel is produced in a hot strip rolling mill or plate rolling mill. Material properties of the rolled product are determined by cooling of the rolled product in the cooling path of the hot strip rolling mill or plate rolling mill. The resulting material properties are also dependent on the time-relative profile of the cooling process.

The time-relative cooling profile is often specified as a time-relative temperature profile. In many cases, a distribution of a water quantity is also specified according to a given cooling strategy combined with a temperature at the end of the cooling path. A two-stage approach is also possible, involving the additional specification of a further temperature at a measuring point within the cooling path. The specification of a temperature is often disadvantageous or problematic, however, due to phase transitions that occur. As a result of the transition heat that occurs during the phase transitions, the specification of cooling based on the temperature is in many cases no longer definite, i.e. there is more than one solution in respect of the water quantity to be applied to the rolled product. However, the material properties resulting from the different solutions then vary.

The operating method disclosed in DE 10 2008 011 303 B4 already works well, even for steels having a high carbon content. However, this method has the disadvantage that the phase transition per se can only be monitored in a suboptimal manner. In particular, it is often not possible to determine the cooling in such a way that the phase transition requires a minimal time. This is disadvantageous in the case of relatively short cooling paths in particular. If the cooling by the air surrounding the rolled product and by the contact with the transport rollers of the cooling path provides a relatively high contribution to the overall cooling, it is also difficult to keep the material properties constant. In the case of relatively long cooling paths, however, it is normal practice to work with an intermediate temperature measurement in the context of a two-stage cooling. In this case, the phase transition can take place relatively quickly. However, this method is limited if the phase transition has already started, since the feedback control is no longer definite if the phase transition is not yet complete at the end of the cooling path.

SUMMARY OF THE INVENTION

The object of the present invention is to improve operation of the cooling path for cooling a rolled product.

Enthalpy is defined as the sum of the internal energy of a body or system and the product of its volume multiplied by the pressure.

According the invention, an operating method of the type cited in the introduction is configured such that the control device additionally receives a target enthalpy.

On the basis of an expected enthalpy for the respective section in the second cooling phase and the target enthalpy, the control device determines a second target cooling medium profile which is to be applied to the respective section of the rolled product in the third cooling phase.

The control device activates the rear cooling devices in accordance with the second target cooling medium profile while the respective section of the rolled product is passing through the rear cooling devices.

The initial energy value and the target energy may be temperatures. This approach is possible in particular if any phase transition has not yet started at the end of the first cooling phase. However, the initial energy value and the target energy may be enthalpies in each case. In this case, the target energy although an enthalpy is nonetheless a value which differs from the target enthalpy.

The control device advantageously determines the first target cooling medium profile in such a way that the maximum possible cooling medium quantity is applied to the respective section of the rolled product as soon as it enters the cooling path, such that the first cooling phase ends as early as possible. This minimizes the length of the cooling path subsection which is required for the purpose of reaching the target energy.

Similarly, the control device advantageously determines the second target cooling medium profile in such a way that the maximum possible cooling medium quantity is applied to the respective section of the rolled product until it leaves the cooling path, such that the third cooling phase starts as late as possible. This leaves a maximal time period for the phase transition to take place.

The rolled product is transported through the cooling path by transport rollers. In a particularly preferred embodiment of the present invention, provision is made for the control device to determine, on the basis of the target energy, or an actual energy that is determined on the basis of the target energy and an actual first cooling medium profile, and a chemical composition of the rolled product, a target roller cooling profile for transport rollers which are arranged in a region of the cooling path that corresponds to the second cooling phase, and to cool these transport rollers in accordance with the target roller cooling profile that has been determined. The target roller cooling profile may be defined for a specific transport roller or for a specific group of transport rollers, e.g. as a simple binary (on/off) function of the time or location of the rolled product. However, finer subdivisions are also possible, allowing intermediate stages for the cooling of the respective transport roller or group of transport rollers.

The target roller cooling profile will often be defined in such a way that the cooling of the transport rollers is switched off while the rolled product is passing through the corresponding region of the cooling path. In this case, the transport rollers are actively cooled during the remaining time, i.e. while no rolled product is passing through the corresponding region of the cooling path. If applicable, the cooling can already be switched off before the rolled product reaches the corresponding region. In a somewhat simplified embodiment, it is alternatively possible for the cooling of the corresponding transport rollers to be reduced or switched off while the rolled product is passing through the corresponding region.

Both approaches allow the temperature or the enthalpy of the sections of the rolled product to be selectively influenced at least to some extent. By virtue of the corresponding influence on the cooling of the transport rollers, it is also possible to extend the resulting adjustment range of the overall cooling which acts on the rolled product. It is thereby possible to improve the quality of the cooling, particularly in the case of a thin rolled product. This is particularly applicable if the cooling of the transport rollers is realized in the form of external cooling, i.e. the cooling medium is sprayed onto the transport rollers externally.

Irrespective of which of the two possibilities is realized, the transport rollers are nonetheless only cooled if no rolled product is situated in the corresponding region of the cooling path. If applicable, this cooling can be realized by applying cooling medium to the transport rollers using those cooling devices which are normally used to apply cooling medium to the rolled product. Alternatively, dedicated cooling devices may be provided for the transport rollers.

The control device preferably determines the expected enthalpy for the respective section in the second cooling phase on the basis of the initial energy value of the respective section of the rolled product and the application of an actual first cooling medium profile to the respective section of the rolled product. This provides a particularly reliable value for the expected enthalpy.

The object is further achieved by a computer program. According to the invention, execution of the machine code by a control device causes the control device to perform an operating method according to the invention, as explained above.

The object is further achieved by a control device for a cooling path. According to the invention, the control device is programmed by a computer program according to the invention.

The object is further achieved by a cooling path for cooling a rolled product. Provision is inventively made for the cooling path to comprise a control device according to the invention, which operates the cooling path using an operating method according to the invention.

The properties, features and advantages of the invention and the manner in which these are achieved, as described above, become clearer and easier to understand in the context of the following description of the exemplary embodiments, these being explained in greater detail with reference to the drawings, in which:

DESCRIPTION OF AN EMBODIMENT

Figure 1:
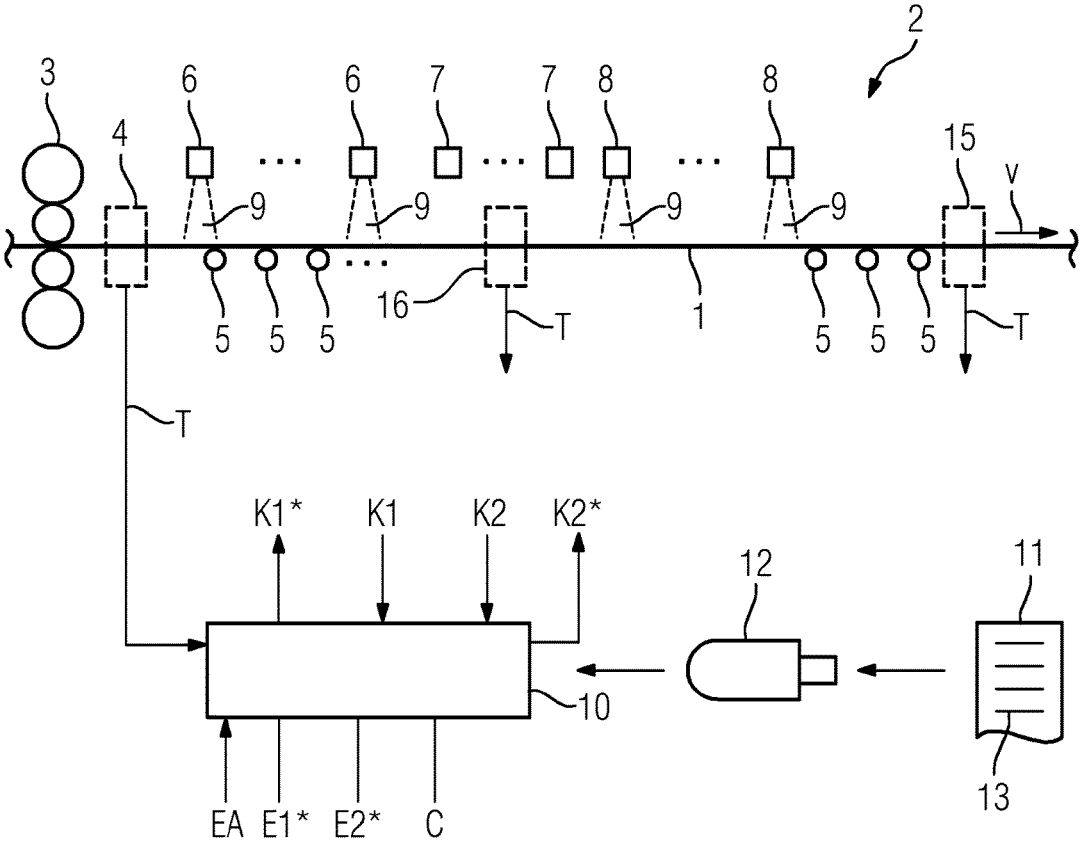
FIG. 1 schematically shows a cooling path.

According to FIG. 1, a rolled product 1 is to be cooled in a cooling path 2. The rolled product 1 comprises a metal. The rolled product 1 is often a flat rolled product, e.g. a metal strip, in particular a steel strip. Alternatively, a flat rolled product 1 may be a heavy plate (likewise of steel in most cases). The cooling path 2 is usually arranged downstream of a mill train, e.g. a finishing train, in which the rolled product 1 has been hot-rolled. The mill train usually comprises a plurality of mill stands. For the sake of clarity, only one mill stand 3, e.g. the last mill stand 3 of the mill train is illustrated in FIG. 1.

A temperature measuring position 4, at which a temperature T of the rolled product 1 is captured, is often arranged between the mill train and the cooling path 2 (or ahead of the cooling path 2 as shown here). The temperature measuring position 4 is subsequently referred to as an input-side temperature measuring position 4 in order to distinguish it from other temperature measuring positions which are introduced later.

The cooling path 2 has a multiplicity of transport rollers 5. The rolled product 1 is transported through the cooling path 2 by means of the transport rollers 5. At least some of the transport rollers 5 are usually driven. The transport rollers 5 together form a transport device by means of which the rolled product 1 is transported through the cooling path 2 at a transport speed v.

The cooling path 2 also has a multiplicity of front cooling devices 6, central cooling devices 7 and rear cooling devices 8. The cooling devices 6 to 8 act on the rolled product 1 in a respective active region. A respective quantity of a liquid and generally water-based cooling medium 9 is applied to the rolled product 1 (more precisely: to that section of the rolled product 1 which is situated in the active region of the respective cooling device 6 to 8 at this time point) by means of the cooling devices 6 to 8.

The cooling path 2 also has a control device 10. The control device 10 controls and monitors the operation of the cooling path 2.

The control device 10 is usually programmed by a computer program 11. The computer program 11 can be supplied to the control device 10 via e.g. a data medium 12, on which the computer program 11 is stored in machine-readable form (preferably in exclusively machine-readable form, in particular in electronic form). The data medium 12 may have any desired format. The illustration in FIG. 1, where the data medium 12 is illustrated as a USB memory stick, is purely exemplary.

The computer program 11 comprises machine code 13 which can be executed by the control device 10. The execution of the machine code 13 by the control device 10 causes the control device 10 to operate the cooling path 2 in accordance with an operating method which is explained in greater detail below with reference to FIG. 2.

Figure 2:
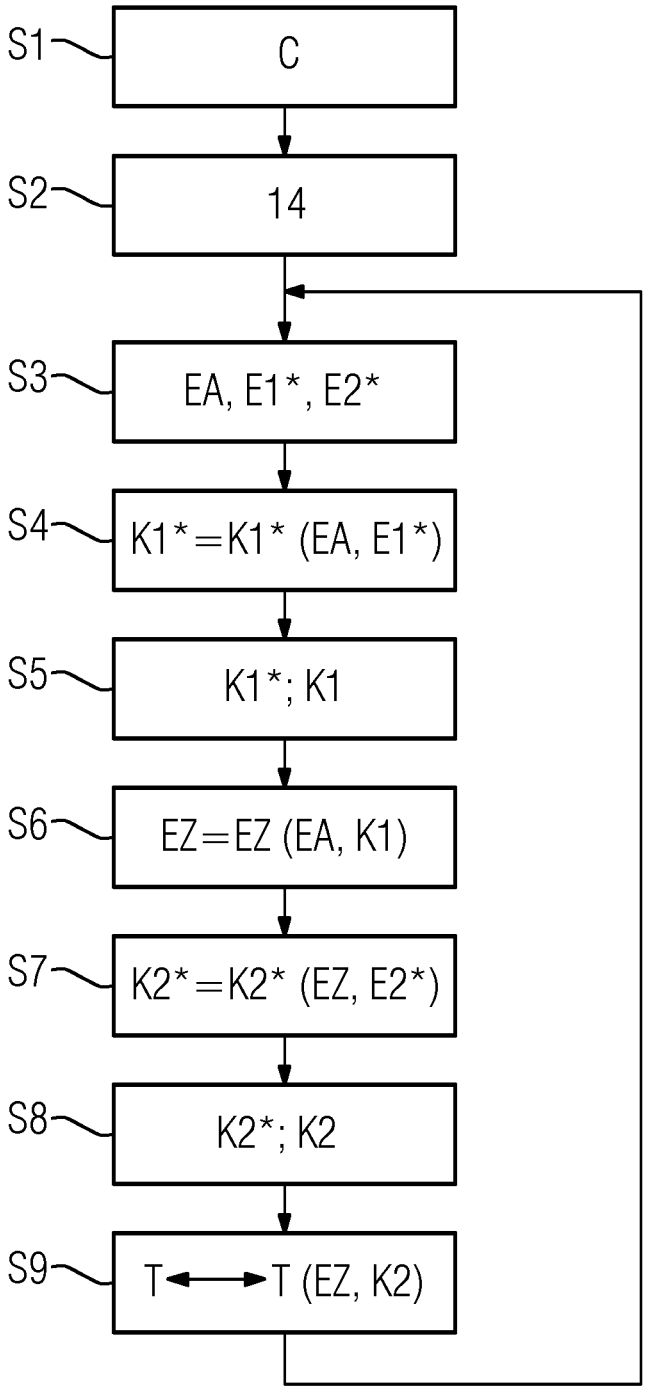
FIG. 2 schematically shows a flow diagram.

According to FIG. 2, in a step S1, the control device 9 initially receives information C relating to the chemical composition of the rolled product 1.

Figure 3:
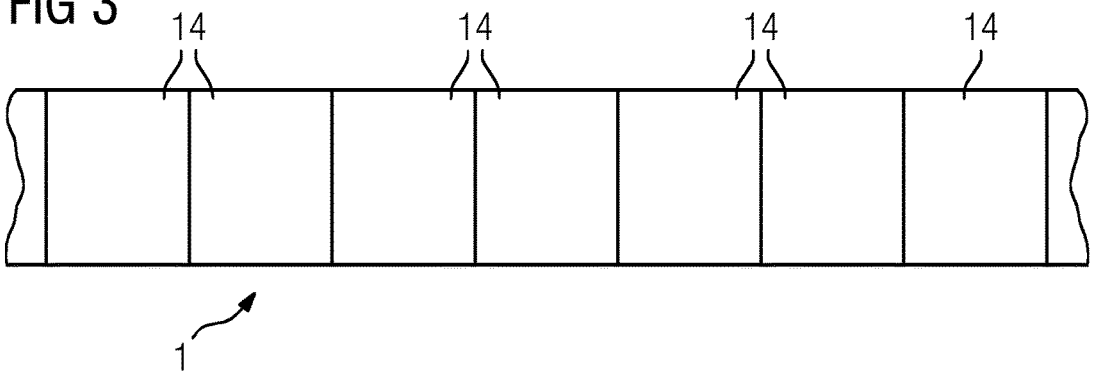
FIG. 3 schematically shows a section of a rolled product.

In a step S2 following thereupon, the rolled product 1 is divided for data processing purposes into a multiplicity of sections 14 within the control device 10 (see FIG. 3). The sections 14 are only virtually present within the control device 10. The sections 14 can be defined by a predetermined length, a predetermined mass or a time cycle, for example. Other divisions are also possible.

In a step S3, the control device 10 receives an initial energy value EA for a respective section 14.

The initial energy value EA may be specified as such to the control device 10. Alternatively, values may be specified to the control device 10, on the basis of which values the control device 10 determines the initial energy value EA. For example, a temperature may be specified to the control device 10. If the temperature is high enough, it can at once be assumed that the respective section 14 of the rolled product 1 is completely in the austenite phase. In this case, the enthalpy can at once be determined as an initial energy value EA directly on the basis of the temperature. It is also possible to specify the temperature and at least one phase component, and to determine the enthalpy on the basis of the temperature and the at least one phase component.

Irrespective of which approach is adopted, the initial energy value EA corresponds to a respective thermal energy that is exhibited by the respective section 14 before it passes through the cooling path 2. The initial energy value EA may be a temperature, e.g. a temperature T of the corresponding section 14 as captured at an input-side temperature measuring position 4. However, the initial energy value EA is preferably an enthalpy. In this case, the phase status of the corresponding section 14 is optionally also taken into account in addition to the temperature T when determining the initial energy value EA.

In the context of the step S3, the control device 10 also receives a target energy E1* and a target enthalpy E2* for the corresponding section 14. The target energy E1* is of the same type as the initial energy value EA. If the initial energy value EA is a temperature, the target energy E1* is also a temperature. If the initial energy value EA is an enthalpy, the target energy E1* is also an enthalpy. However, the target energy E1* is a different value from the target enthalpy E2* in each case. The target enthalpy E2* is therefore always an enthalpy. However, it is possible to specify the target enthalpy E2* either directly by specifying an enthalpy or indirectly by specifying a temperature and at least one phase component.

Figure 4:
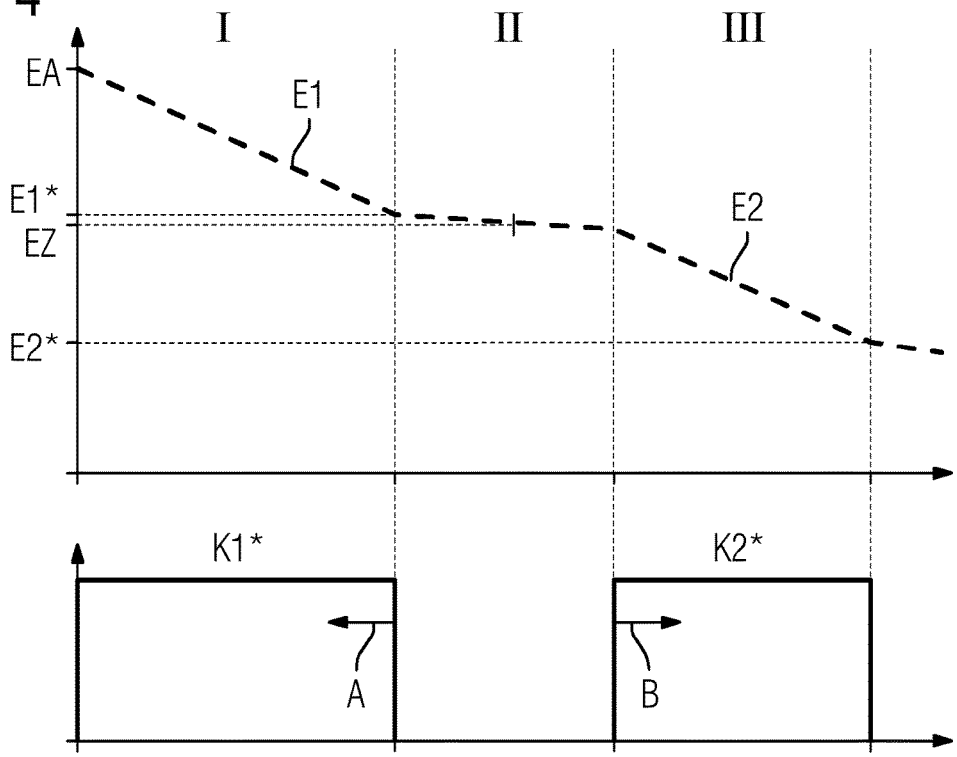
FIG. 4 schematically shows a cooling profile for a section of the rolled product as a function of the time, FIG. 5 schematically shows a flow diagram, FIG. 6 schematically shows an activation status of the cooling path as a function of the location, and FIG. 7 schematically shows a flow diagram.

The target energy E1* stipulates the actual energy E1 which the corresponding section 14 of the rolled product 1 is to exhibit at the end of a first cooling phase I (see FIG. 4). The target enthalpy E2* stipulates the actual enthalpy E2 which the corresponding section 14 of the rolled product 1 is to exhibit at the end of a third cooling phase III (see FIG. 4). The first and the third cooling phase I, III are separated from each other by a second cooling phase II as per FIG. 4. However, the second cooling phase II immediately follows the first cooling phase I. Likewise, the third cooling phase III immediately follows the second cooling phase II.

In a step S4, the control device 10 determines a first target cooling medium profile K1*. The first target cooling medium profile K1* stipulates the cooling medium quantity that is to be applied to the respective section 14 of the rolled product 1 in the first cooling phase I. The control device 10 determines the first target cooling medium profile K1* on the basis of the initial energy value EA and the target energy E1*. That determination is carried out in such a way that an actual energy E1 of the corresponding section 14 of the rolled product 1 at the end of the first cooling phase I corresponds as closely as possible to the target energy E1*.

The determination of the first target cooling medium profile K1* by the control device 10 can take place as required. The control device 10 preferably determines the first target cooling medium profile K1* in such a way that the maximum possible cooling medium quantity is applied to the respective section 14 of the rolled product 1 as soon as it enters the cooling path 2 and until the total required cooling medium quantity of the first cooling phase I has been deposited onto the corresponding section 14. This ensures that the first cooling phase I ends as early as possible. The corresponding approach is indicated in FIG. 4 by an arrow A, which is intended to indicate that the end of the first cooling phase I is moved to the earliest possible time point.

In a step S5, the control device 10 activates the front cooling devices 6 in accordance with the determined first target cooling medium profile K1*. Said activation takes place while the corresponding section 14 of the rolled product 1 is passing through the front cooling devices 6.

The control device 10 preferably also captures an actual activation status of the corresponding front cooling devices 6 during this period, i.e. in the context of the step S5, and determines an actual first cooling medium profile K1 therefrom. The difference between the first target cooling medium profile K1* and the actual first cooling medium profile K1 is that the first target cooling medium profile K1* corresponds to a target activation of the front cooling devices 6, whereas the actual first cooling medium profile K1 corresponds to the time-relative profile of the deposition by the front cooling devices 6 of an actual cooling medium quantity onto the corresponding section 14 of the rolled product 1.

In a step S6, the control device 10 determines an expected enthalpy EZ. The expected enthalpy EZ is an enthalpy which is exhibited by the corresponding section 14 of the rolled product 1 in the second cooling phase II. The expected enthalpy EZ may be exhibited by the corresponding section 14 of the rolled product 1 at the beginning, in a central region or at the end of the second cooling phase II. The control device 10 can determine the expected enthalpy EZ in the context of the step S6 on the basis of the initial energy value EA and the first target cooling medium profile K1*. However, the control device 10 preferably determines the expected enthalpy EZ as per the illustration in FIG. 2 on the basis of the initial energy value EA of the respective section 14 of the rolled product 1 and the application of the actual first cooling medium profile K1 to the respective section 14 of the rolled product 1.

In a step S7, the control device 10 determines a second target cooling medium profile K2*. The second target cooling medium profile K2* stipulates the cooling medium quantity that is to be applied to the respective section 14 of the rolled product 1 in the third cooling phase III. The control device 10 determines the second target cooling medium profile K2* on the basis of the expected enthalpy EZ for the respective section 14 in the second cooling phase II and the target enthalpy E2*. That determination is carried out in such a way that an actual enthalpy E2 of the corresponding section 14 of the rolled product 1 at the end of the third cooling phase III corresponds as closely as possible to the target enthalpy E2*.

The determination of the second target cooling medium profile K2 by the control device 10 can take place as required. The control device 10 preferably determines the second target cooling medium profile K2* in such a way that the maximum possible cooling medium quantity is applied to the respective section 14 of the rolled product 1 until it leaves the cooling path 2 (=last possible time point), such that the total required cooling medium quantity of the third cooling phase III is deposited onto the corresponding section 14. This ensures that the third cooling phase III starts as late as possible. The corresponding approach is indicated in FIG. 4 by an arrow B, which is intended to indicate that the beginning of the third cooling phase III is moved to the latest possible time point.

In a step S8, the control device 10 activates the rear cooling devices 8 in accordance with the determined second target cooling medium profile K2*. That activation takes place while the corresponding section 14 of the rolled product 1 is passing through the rear cooling devices 8.

The steps S3 to S8 are performed according to the illustration in FIG. 2 for each section 14 of the rolled product 1.

As a consequence, while passing through the cooling path 2, the sections 14 of the rolled product 1 are initially cooled in the first cooling phase I by means of the front cooling devices 6 of the cooling path 2 using the liquid cooling medium 9. However, in the second cooling phase II, which follows the first cooling phase I, the sections 14 are not cooled using the liquid cooling medium 9. The corresponding central cooling devices 7 are therefore not activated by the control device 10. Only the inevitable heat loss to the environment, in particular to the air and the transport rollers 5, occurs in the second cooling phase II. In the third cooling phase III, which follows the second cooling phase II, the sections 14 are cooled again by means of the rear cooling devices 8 using the liquid cooling medium 9.

In many cases, a (further) temperature measuring position 15, at which a temperature T of the rolled product 1 is also captured, is arranged after the cooling path 2 as per the illustration in FIG. 1. The temperature measuring position 15 is subsequently referred to as an output-side temperature measuring position 15 in order to distinguish it from the input-side temperature measuring position 4. If the output-side temperature measuring position 15 is present, the temperature T of the rolled product 1 as captured there is compared with an expected temperature by the control device 10 in a step S9. The expected temperature can be determined by the control device 10, e.g. on the basis of the expected enthalpy EZ and the second target cooling medium profile K2* or, preferably, on the basis of the expected enthalpy EZ and an actual second target cooling medium profile K2. On the basis of the comparison, a model of the cooling path 2 (not shown in the drawings) can be adapted within the control device 10, for example.

As shown in FIG. 1, it is similarly possible to arrange a temperature measuring position 16, which is subsequently referred to as a central temperature measuring position 16 in order to distinguish it from the input-side and output-side temperature measuring positions 4, 15, in that region of the cooling path 2 which corresponds to the second cooling phase II. Capture of a temperature T of the rolled product 1 can also take place here. Here too, adaptation of the model of the cooling path 2 can take place in a similar manner to the previous adaptation.

The target energy E1* is preferably defined in such a way that a phase transition of the corresponding section 14 of the rolled product 1 has not started or has only just started and a transition speed of the metal is maximal at the corresponding temperature T of the corresponding section 14 of the rolled product 1. The temperature T should therefore be held as constant as possible in the second cooling phase II. Although it is not usually possible to hold the temperature 100% constant, this should nonetheless be endeavored as far as possible. To this end, it is advantageous as far as possible to adjust the heat loss such that it then corresponds as closely as possible to the transition heat which is generated by the phase transition.

The transport rollers 5 often exhibit a cooling. Said cooling may take the form of internal cooling, for example. In this case, a liquid cooling medium flows through the transport rollers 5, preferably in the vicinity of the outer circumference of the transport rollers 5 in particular. Alternatively, the cooling medium can be sprayed onto the transport rollers 5 externally by means of spray nozzles or similar (external cooling). In both cases, the liquid cooling medium is mainly water or at least water-based.

Figure 5:
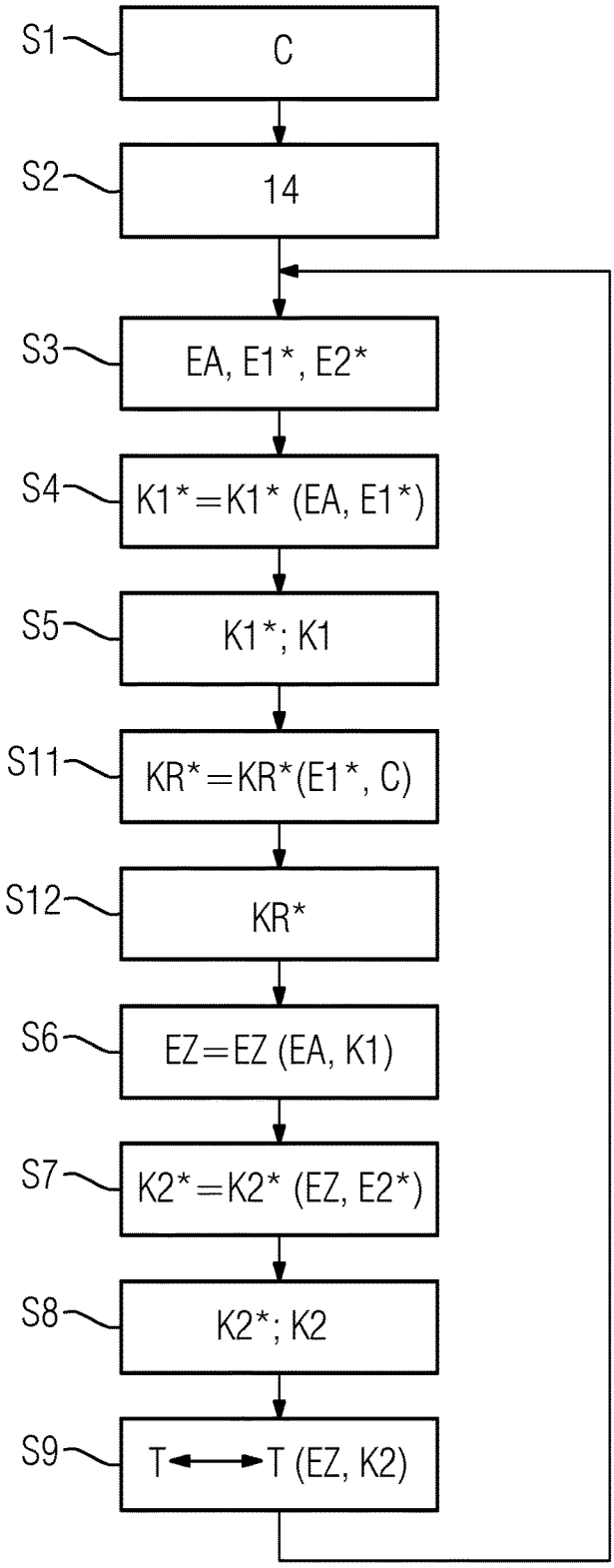

In each case, but particularly in the case of external cooling, the approach as per FIG. 2 can be modified according to FIG. 5.

The steps S1 to S8 are also present in the approach according to FIG. 5. However, steps S11 and S12 are also included. In the step S11, the control device 10 determines a target roller cooling profile KR*. The target roller cooling profile KR* stipulates a target cooling of the transport rollers 5 arranged in that region of the cooling path 2 which corresponds to the second cooling phase II. The determination in the step S11 takes place on the basis of the target energy E1* or the actual energy E1. During that determination, the control device 10 also uses the information C relating to the chemical composition of the rolled product 1.

Figure 6:
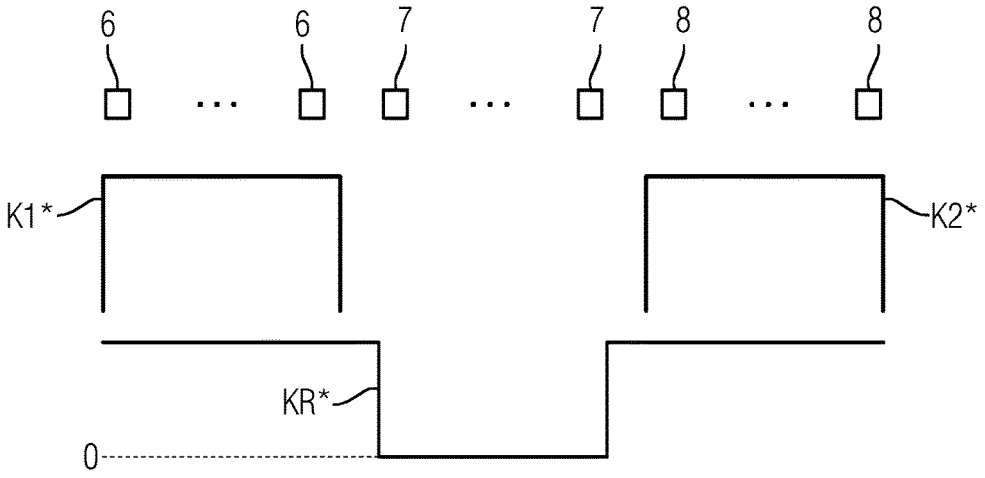

In the step S12, the cooling of the corresponding transport rollers 5 takes place in accordance with the target roller cooling profile KR*. Depending on the result of the determination in the step S11, it is possible that the cooling of the transport rollers 5 will be maintained in this region of the cooling path 2. Alternatively, it is possible that the cooling of the transport rollers 5 in this region of the cooling path 2 will be reduced or even switched off completely in extreme cases. Such an extreme case is illustrated in a purely exemplary manner in FIG. 6.

Figure 7:
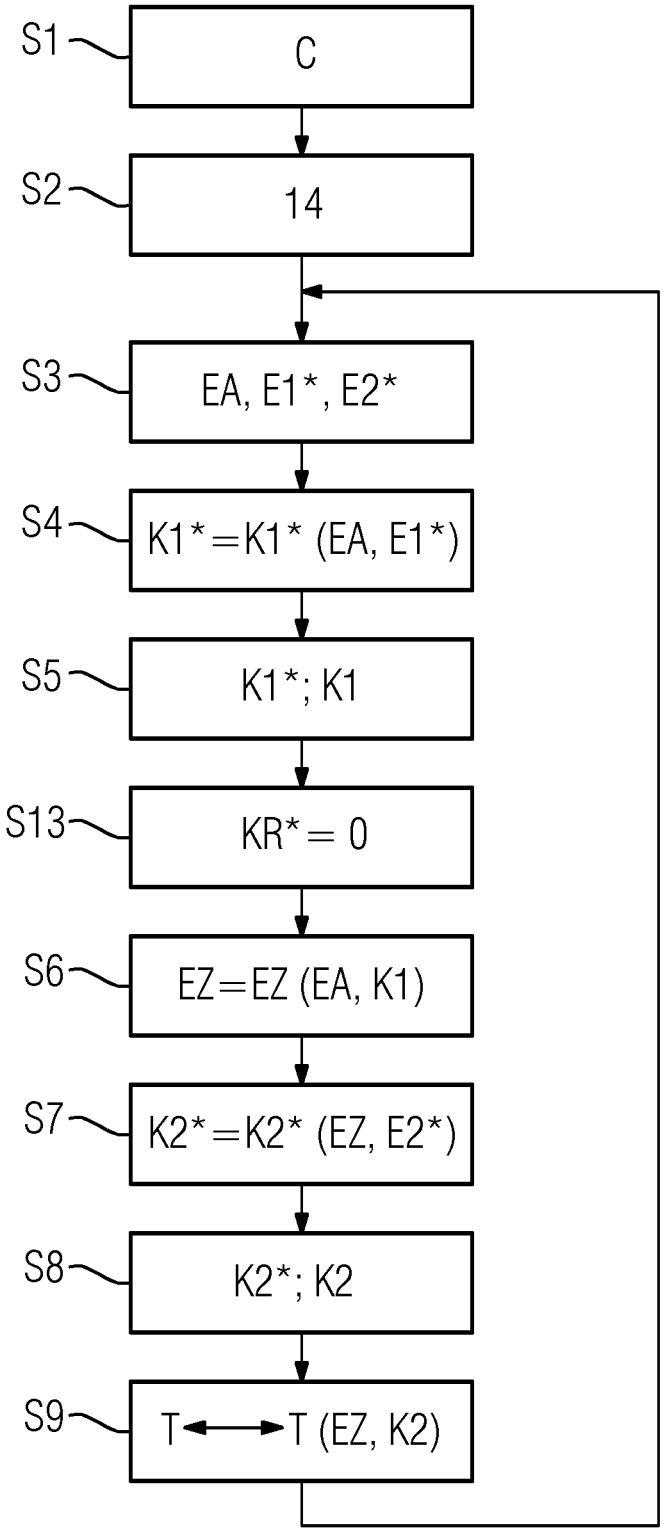

Alternatively, in a simplified approach, it is possible as per FIG. 7 to omit the step S11 and to perform a step S13 instead of the step S12. In this case, in the step S13, the cooling of the transport rollers 5 is reduced or simply switched off in that region of the cooling path 2 which corresponds to the second cooling phase II.

In both cases, the adaptation of the cooling of the transport rollers 5 only takes place during the time period for which the rolled product 1 is situated in the corresponding region of the cooling path 2, i.e. that region which corresponds to the second cooling phase II. If no rolled product is situated in this region, the transport rollers 5 are cooled at certain times or continuously.

In summary, the present invention therefore relates to the following substantive matter:

Sections 14 of a rolled product 1 while passing through a cooling path 2 are initially cooled by means of front cooling devices 6 in a first cooling phase I, are then not cooled in a second cooling phase II following thereupon, and are finally cooled again by means of rear cooling devices 8 of the cooling path 2 in a third cooling phase III following thereupon. A control device 10 of the cooling path receives in each case an initial energy value EA which is exhibited by the sections 14 before they pass through the cooling path 2. It additionally receives a target energy E1* and a target enthalpy E2*. The control device 10 determines, on the basis of the initial energy value EA and the target energy E1*, a first target cooling medium profile K1*. It activates the front cooling devices 6 in accordance with the first target cooling medium profile K1* while the respective section 14 is passing through the front cooling devices 6. The control device 10 determines a second target cooling medium profile K2* on the basis of an expected enthalpy EZ for the respective section 14 in the second cooling phase II and the target enthalpy E2*. It activates the rear cooling devices 8 in accordance with the second target cooling medium profile K2* while the respective section 14 of the rolled product 1 is passing through the rear cooling devices 8.

The present invention has many advantages. In particular, the material properties can be adjusted reliably even in the case of steels having a high carbon content. Moreover, the present invention can also be applied if the cooling path 2 is relatively short. It is also possible to very uniformly adjust the material properties over the entire length of the rolled product 1. The rolled product 1 therefore exhibits relatively little variability of its material properties over its length. Good flatness is also assured downstream of the cooling path 2. If the rolled product 1 is a strip, strip travel problems and coiler problems are prevented. Finally, the transition speed can be maximized.

Although the invention is illustrated and described in detail with reference to the preferred exemplary embodiment, the invention is not limited by the examples disclosed herein, and other variations may be derived therefrom by a person skilled in the art without thereby departing from the scope of the invention.

The invention claimed is:

1. An operating method for a cooling path for cooling a rolled product made of metal comprising:

passing sections of the rolled product through the cooling path and initially cooling the sections using front cooling devices of the cooling path, the front cooling devices using a liquid cooling medium in a first cooling phase, not cooling the sections using the liquid cooling medium in a second cooling phase which follows the first cooling phase, cooling the sections again using rear cooling devices of the cooling path, the rear cooling devices using the liquid cooling medium in a third cooling phase which follows the second cooling phase, receiving, by a control device of the cooling path, an initial energy value which is exhibited by a respective section of the rolled product before it passes through the cooling path, receiving, by the control device, a target energy, determining, by the control device, a first target cooling medium profile on the basis of the initial energy value and the target energy, activating, by the control device, the front cooling devices in accordance with the first target cooling medium profile while the respective section of the rolled product is passing through the front cooling devices, receiving, by the control device, a target enthalpy which predicts the actual enthalpy which the respective section of the rolled product is to exhibit at an end of the third cooling phase, determining, by the control device, on the basis of an expected enthalpy for the respective section in the second cooling phase and the target enthalpy, a second target cooling medium profile to be applied to the respective section of the rolled product in the third cooling phase, and activating, by the control device, the rear cooling devices in accordance with the second target cooling medium profile while the respective section of the rolled product is passing through the rear cooling devices.

2. The operating method as claimed in claim 1, wherein the initial energy value and the target energy are enthalpies.

3. The operating method as claimed in claim 1, further comprising determining, by the control device, the first target cooling medium profile such that the maximum possible cooling medium quantity is applied to the respective section of the rolled product as soon as it enters the cooling path, such that the first cooling phase ends as early as possible.

4. The operating method as claimed in claim 1, further comprising determining, by the control device, the second target cooling medium profile such that the maximum possible cooling medium quantity is applied to the respective section of the rolled product when it leaves the cooling path, such that the third cooling phase starts as late as possible.

5. The operating method as claimed in claim 1, further comprising transporting the rolled product through the cooling path by means of transport rollers;

determining, by the control device, on the basis of the target energy, or an actual energy, that is determined on the basis of the target energy, and an actual first cooling medium profile, and on the basis of a chemical composition of the rolled product, a target roller cooling profile for transport rollers, which are arranged in a region of the cooling path that corresponds to the second cooling phase, and cooling, by the control device, the transport rollers in accordance with the target roller cooling profile that has been determined.

6. The operating method as claimed in claim 1, further comprising transporting the rolled product through the cooling path by means of transport rollers, and reducing or switching off cooling of the transport rollers arranged in a region of the cooling path which corresponds to the second cooling phase.

7. The operating method as claimed in claim 6, further comprising cooling the transport rollers only if no rolled product is situated in the region of the cooling path which corresponds to the second cooling phase.

8. The operating method as claimed in claim 1, further comprising:

determining, by the control device, the expected enthalpy for the respective section of the rolled product in the second cooling phase, based on the initial energy value of the respective section of the rolled product and the application of an actual first cooling medium profile to the respective section of the rolled product.

9. The operating method as claimed in claim 1, wherein the target energy predicts the actual energy which the respective section of the rolled product is to exhibit at an end of the first cooling phase.

10. A computer program product comprising a non-transitory computer readable medium on which a computer program comprising machine code is recorded, the machine code being executed by a control device for a cooling path for a rolled product, wherein the execution of the machine code by the control device causes the control device to operate the cooling path in accordance with an operating method for a cooling path for cooling a rolled product made of metal comprising:

passing sections of the rolled product through the cooling path and initially cooling the sections using front cooling devices of the cooling path, the front cooling devices using a lipid cooling medium in a first cooling phase, not cooling the sections using the liquid cooling medium in a second cooling phase which follows the first cooling phase, cooling the sections again using rear cooling devices of the cooling path, the rear cooling devices using the liquid cooling medium in a third cooling phase which follows the second cooling phase, receiving, by a control device of the cooling path, an initial energy value which is exhibited by a respective section of the rolled product before it passes through the cooling path, receiving, by the control device, a target energy, determining, by the control device, a first target cooling medium profile on the basis of the initial energy value and the target energy, activating, by the control device, the front cooling devices in accordance with the first target cooling medium profile while the respective section of the rolled product is passing through the front cooling devices, receiving, by the control device, a target enthalpy which predicts the actual enthalpy which the respective section of the rolled product is to exhibit at an end of the third cooling phase, determining, by the control device, on the basis of an expected enthalpy for the respective section in the second cooling phase and the target enthalpy, a second target cooling medium profile to be applied to the respective section of the rolled product in the third cooling phase, and activating, by the control device, the rear cooling devices in accordance with the second target cooling medium profile while the respective section of the rolled product is passing through the rear cooling devices.

* * * * *